United States Patent [19]

Hillinger

[11] 4,106,679

[45] Aug. 15, 1978

[54] TOOL HOLDER

[75] Inventor: George Hillinger, Hollywood, Calif.

[73] Assignee: Action Leathercraft, Inc., Commerce, Calif.

[21] Appl. No.: 762,566

[22] Filed: Jan. 26, 1977

[51] Int. Cl.[2] ..... A45F 5/00

[52] U.S. Cl. ..... 224/26 B; 224/5 A; 224/3

[58] Field of Search ..... 224/26 B, 26 R, 5 R, 224/5 A, 3, 1 R; 248/315, 278

[56] References Cited

U.S. PATENT DOCUMENTS

| | | | |
|---|---|---|---|
| 777,996 | 12/1904 | Applegate | 248/315 X |
| 954,765 | 4/1910 | Rune | 224/5 A UX |
| 1,600,027 | 9/1926 | Welsand | 224/5 A |
| 1,797,098 | 3/1931 | Minehart | 224/5 A X |
| 2,618,419 | 11/1952 | Vanish | 224/5 A |

FOREIGN PATENT DOCUMENTS

| | | | |
|---|---|---|---|
| 360,110 | 4/1906 | France | 224/5 A |

*Primary Examiner*—Trygve M. Blix
*Assistant Examiner*—Jerold M. Forsberg
*Attorney, Agent, or Firm*—Paul D. Supnik

[57] ABSTRACT

A tool holder particularly suited for carrying a hammer or a hatchet from a wearer's waist belt includes a tool suspension arrangement joined to a waist belt suspended pliant pad. The tool suspension arrangement comprises a pivot rod extending normally from and joined to the pad and a protruding support element. Spaced apart end portions of the support element are riveted to the pad and a forward portion of the support element spaced apart from the pad supports the pivot rod. A swivelable pivot rod supported element includes a lower clip portion engaging a laterally extendable tool loop in frictionally pivotable relationship. The tool loop is movable from a position substantially flush with the pad avoiding inconvenient interference to the wearer, to a tool suspending position extending laterally from the pad. For use, the tool loop is rotated from the flush position to the extended position. The shaft of an implement such as a hammer is placed through the tool loop with the crosspiece of the hammer being suspended therefrom. The tool loop swivels about the pivot rod to maintain the hammer in a generally upright position, even though bending over by the wearer tilts the waistbelt suspended pad, thus preventing the hammer from falling out of the tool loop, and the hammer crosspiece to be readily grasped and rotated about an arc to facilitate insertion and removal.

14 Claims, 9 Drawing Figures

TOOL HOLDER

BACKGROUND OF THE INVENTION

1. Field of the Invention

This invention pertains to tool holders. More particularly, the invention relates to waist belt supported hammer and hatchet suspension arrangements.

2. Description of the Prior Art

Hammer holders are currently in use which are supported by a wearer's waist belt. These devices have a leather pad to which is attached a metal element having a pair of elongated spaced apart upright parallel portions which are joined flush to the leather pad. A semicircular loop portion joining adjacent ends of the two upright portions and extending normal to the pad suspend the crosspiece of a tool.

SUMMARY OF THE INVENTION

An improved tool holder removably suspending a tool in an upright position in accordance with this invention generally includes pad means and a tool suspension arrangement coupled to and supported by the pad means. The tool suspension arrangement has a laterally disposed pivot such as a rod defining a swivel axis and means supported by and swivelable about the pivot. For suspending an implement of the type having a shaft portion defining a cross-sectional area and a different portion defining an area greater than the cross-sectional area of the shaft, the swivelably supported means includes a tool loop remote from the pivot and extendable to a lateral plane. The tool loop is swivelable about the pivot so that insertion and removal of the implement is facilitated by the shaft bearing on and rotating the tool loop. Additionally the swiveling enhances the comfort of the wearer by allowing motion of the tool with body movement, maintaining the hammer in a generally upright position. The tool loop is joined to the swivel means remote from the pivot means providing a pivot arm to reduce tool sway.

In a more specific example, the tool suspension arrangement includes a protruding support element for supporting the pivot rod normal to the pad. A swivel element pivotally coupled to the rod provides an arcuate motion about the swivel axis. The tool loop is pivotally coupled to the swivel element so that the tool loop is movable from a position extending laterally and generally normal to the support pad to a position generally flush against the support pad and upright when not in use.

Additional features in accordance with this invention include a nub or stop means for limiting downward movement of the tool loop below the lateral plane when in use. The protruding support element comprises a pair of opposing end portions flush with and fastened to the pad. In addition, a forward or protruding portion is spaced apart from the pad extending from the end portions and side portions extend from the end portions to the forward portion. The side portions are sufficiently spaced apart from oneanother and the pivot element is sufficiently narrow so that the tool loop is allowed to swivel about an arc in excess of about 60°. To maintain the tool loop in the lateral position or in the flush upright position, the tool loop is frictionally joined to the pivot element in force fitting relationship. The tool loop includes a flattened surface generally normal to the loop along a segment of the loop frictionally engaged by the swivel element so that only limited manual effort is required to begin the movement from the upright position toward the outwardly extending lateral position. The swivel element comprises a folded or looped portion defining two spaced-apart generally parallel leaves having coaxial aperture means extending through each. The pivot rod extends through the aperture means so that the swivel element is rotatable about the rod.

In some examples, the tool holder comprises a rider plate disposed against and protecting the pad as the swivel element swivels about the pivot axis, the pivot element and the tool loop riding against the plate. The tool loop is resiliently biased towards the pad so that the loop is extendable to a lateral position upon the application of manual force to rotate the tool loop about the tool loop axis. A multi-arm clip-on adapter may be removably snapped onto the tool loop for reducing the size of the tool loop opening for use with implements having smaller perimeters than that of the inner perimeter of the tool loop. Plural arms provide multiple separate openings to suspend several tools.

BRIEF DESCRIPTION OF THE DRAWINGS

The nature of the invention described herein may be best understood and appreciated by the following description taken in connection with the accompanying drawings in which.

DETAILED DESCRIPTION

Figure 1:
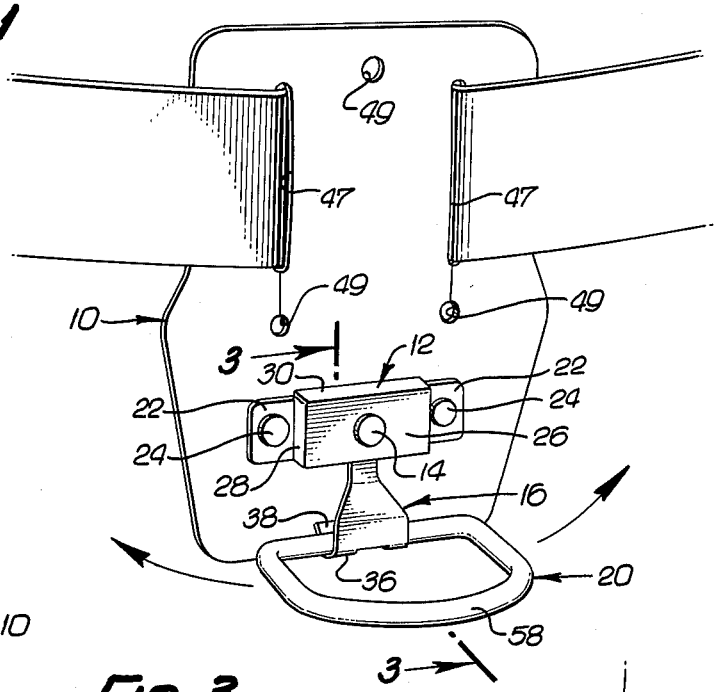
FIG. 1 is a perspective view of a tool holder in accordance with this invention suspended from a waist belt.
Figure 2:
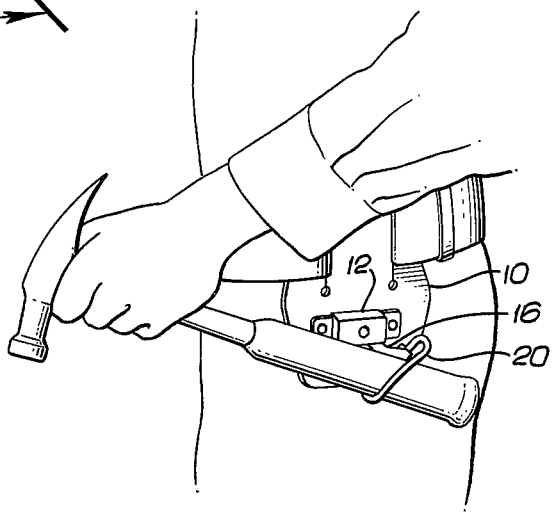
FIG. 2 is a perspective view of the tool holder depicted in FIG. 1 shown in use by a wearer.

With particular reference to FIGS. 1 and 2, a tool holder in accordance with this invention generally comprises a pad 10 for supporting a tool suspension arrangement adjacent thereto and a tool suspension arrangement coupled to the pad 10. The pad 10 is preferably of a somewhat pliant material such as leather and may consist of a single flat sheet to be supported on a waist belt or may be a curved portion of a more elaborate tool pouch arrangement. The suspension arrangement comprises a support element 12 joined to the pad 10 and supporting a pivot rod 14 or rivet extending normal to the pad 10. A swivel element 16 is swivelably supported by the pivot rod 14. Spaced apart from the pivot rod 14, a tool loop 20 is pivotally coupled to the swivel element 16 so that the tool loop 20 may pivot about an axis normal to the rod to retract the tool loop 20 flush against the pad 10.

When in use, the hammer remains in a generally upright position even though the wearer may tilt the waist belt worn pad 10 by bending over. Since the tool loop 20 swivels about the pivot rod 14, gravitational forces tend to maintain the tool's position. This provides for safety by preventing the tool from falling from the wearer, and potentially injuring the wearer or others.

It has been found that tool insertion and removal is facilitated by allowing the tool loop 20 to swivel about the pivot rod 14. This also enhances the comfort of a wearer by partly absorbing reaction forces of tool motion by the wearer's movement.

The tool loop 20 is remotely coupled to the pivot rod 14 by the swivel element 16 which provides a pivot arm to reduce the frequency of tool sway. If the tool loop 20 were to be permanently outwardly extended, it could interfere with the user by coming into contact with adjacent objects. By utilizing a pivotal loop configuration, the loop 20 may be moved to the retracted position flush with the pad 10 avoiding interference with objects and providing for compact storage.

The support element 12 includes two spaced apart apertured end portions 22. A pair of spaced apart rivets 24 join the end portions 22 of the support element 12 to the pad 10. The support element 12 also has a forward position 26 of the element 12 spaced apart from the pad 10 and a pair of facing side portions 28 extending between the end portions 20 and the forward portion 26. The swivel element 16 defines a sufficiently narrow width adjacent the lower portion of the side portions 22 and the side regions are sufficiently spaced apart to allow the tool loop 20 to swivel about an arc in excess of about 60°. An upper portion 30 of the support element extending from the forward portion 26 to the pad 10 protectively shields the upper portion of the swivel element 16 from the wearer.

Figure 3:
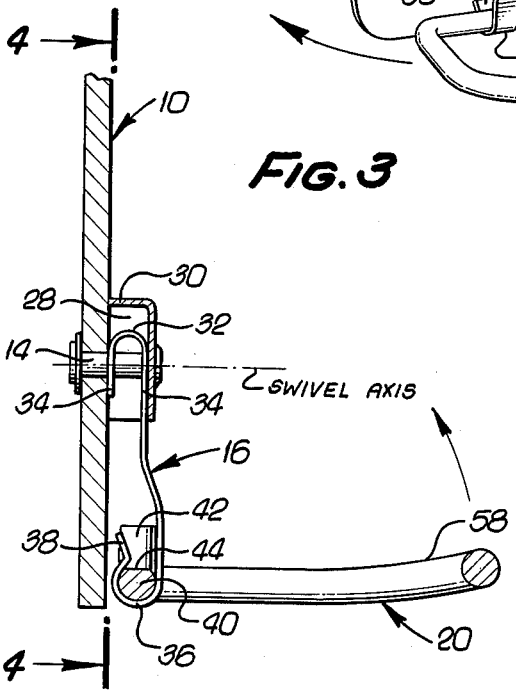
FIG. 3 is a cross-sectional side view taken along the lines 3—3 of FIG. 1 in which the tool loop is extended to a lateral position.
Figure 4:
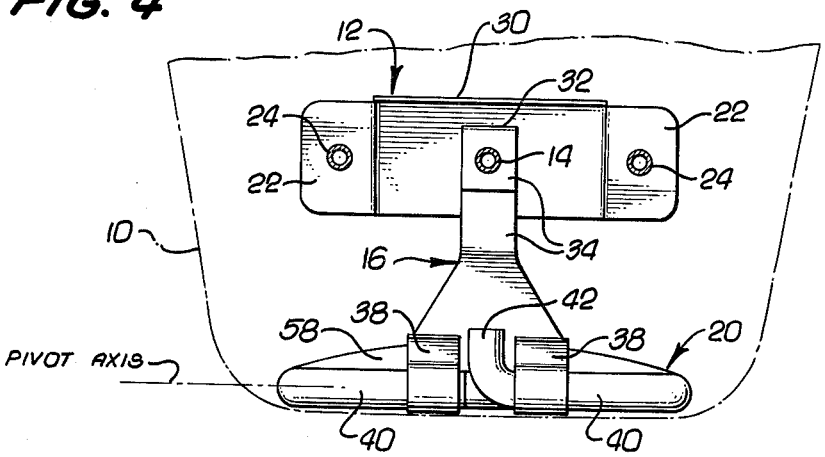
FIG. 4 is a cross-sectional rear view taken along the lines 4—4 of FIG. 1.
Figure 5:
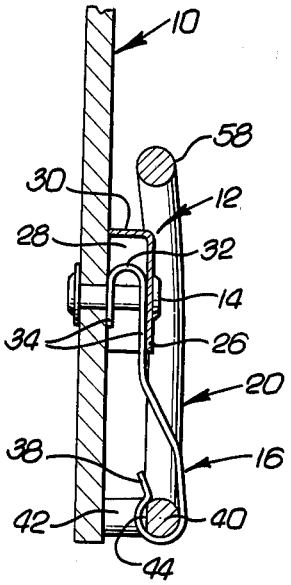
FIG. 5 is a cross-sectional side view of the tool holder depicted in FIG. 1 in which the tool loop is flush against the pad.

With particular reference to FIGS. 3, 4 and 5, the swivel element 16 is preferably of spring steel and comprises a loop portion 32 defining spaced-apart apertured leaves 34. The pivot rod 14 passes through apertures of the leaves 34 to swivelably suspend the swivel element 16 from the pivot rod 14 about a swivel axis.

The swivel element 16 includes a depending portion including a clip portion 36 having a pair of spaced apart tabs 38, each partially surrounding and supporting a segment of the tool loop 20. The tool loop 20 includes a pair of adjacent inwardly directed portions 40, one of which having a normally extending stop element or nub 42 for bearing against the swivel element 16 when the tool loop is laterally extended. The inwardly directed portions 40 are pivotally coupled to the spaced apart tabs 38 of the swivel element 16 in force fitting relationship to maintain the tool loop 20 in position. The inwardly directed portions 40 of the tool loop 20 defines a pivot axis about which the tool loop 20 rotates.

On one of the inwardly directed portions 40, a flattened surface 44 generally normal to the tool loop plane allows the tool loop 20 to be easily moved from the upright position substantially flush with the pad 10 as in FIG. 5 towards the laterally extending position as in FIG. 3. The tabs 38, only partially surrounding the inwardly directed portions 40 are less compressed when surrounding the flattened surfaces 44 providing reduced frictional forces about the loop 20. The tool loop 20 defines an inner perimeter substantially clearing the support element 12 when the loop 20 is upright as viewed in FIG. 5. However the loop 20 may have an inner perimeter sufficiently small to snap onto the side portions 28 of the support element 12.

The pad 10 has a pair of upright slots 47 for receiving a waist belt. Adjacent apertures 49 are for use as a starting opening in enlarging the slots when larger waist belts wider than the slot width are used. A central aperture 49 is used to hang the tool holder on a hook when not in use.

Figure 6:
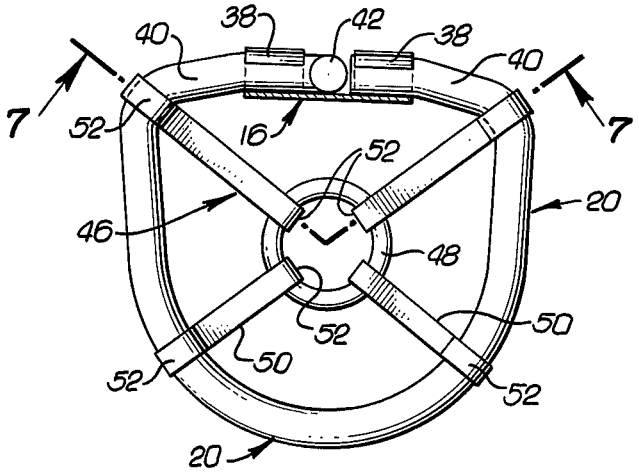
FIG. 6 is a top view of a portion of a tool holder in accordance with this invention having a multi-arm clipon adapter.
Figure 7:
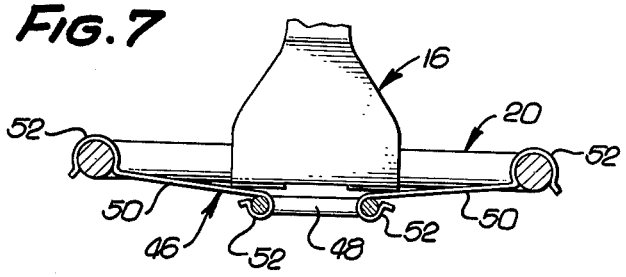
FIG. 7 is a detailed cross-sectional view taken along lines 7—7 of FIG. 6.

FIGS. 6 and 7 depict an example of the invention having an adapter 46 removably coupled to the tool loop 20 for reducing the effective size of the inner perimeter of the tool loop opening. The adapter 46 comprises an inner ring 48 and a plurality of arms 50 terminating at both ends in clip-on portions 52. The arms 50 extend central to the tool loop 20 to provide separate openings to receive tool shafts and provide separate shoulders suspending a plurality of tools. As seen in FIG. 7, the inner ring 48 may be spaced apart beneath the tool loop 20 when in an extending position so that the loop may at least partially clear the support element 12 when the loop 20 is in the upright position with the adapter attached. It should be recognized that a multiple tool or reduced tool size adapter may take additional forms other than the example depicted in FIGS. 6 and 7.

Figure 8:
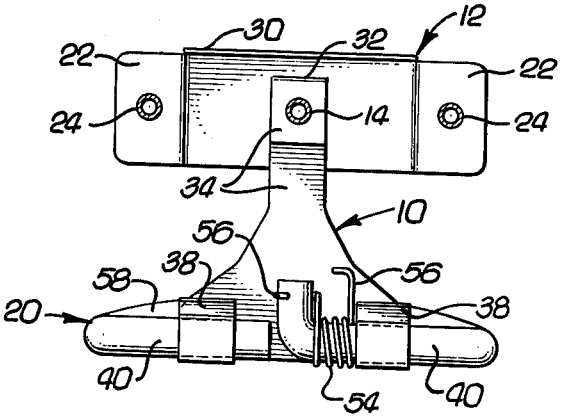
FIG. 8 is a rear view of a portion of a different example of a tool holder in accordance with the invention utilizing a resiliently biased tool loop.

FIG. 8 depicts an example of the invention in which the tool loop 20 is resiliently biased towards the upright position generally flush with the pad 10. A spring 54 terminates in an extending torque arm 56 at each opposing end. One torque arm 56 of the spring 54 bears against the swivel element 16 so that the tool loop 20 resists downward motion. However, the spring 54 has a sufficient force to raise the tool loop 20 from an extended position to a position generally flush or parallel to the pad 10. The force to extend the tool loop 20 downward is sufficiently low so that it can be manually moved forward to the lateral position with ease. An upwardly curved portion 58 extending remote from the pivot axis of the tool loop 10 as best viewed in FIG. 3 nestles the crosspiece of the tool toward the pad 10. Thus a plane substantially passing through the loop 20 is generally normal to the pad 10. In some tool holders in accordance with this invention the tool loop 20 may include a locking arrangement (not shown) to maintain the loop 20 in the laterally extending position.

Figure 9:
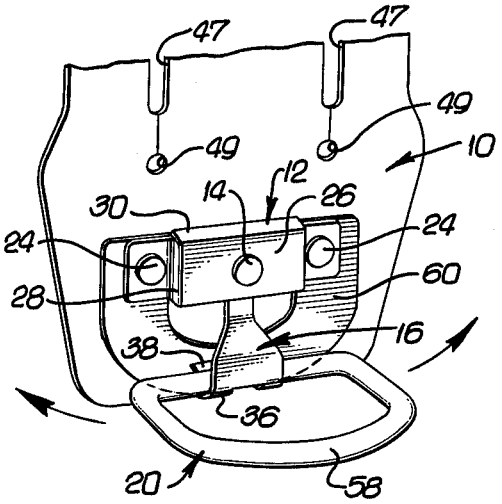
FIG. 9 is a front perspective view of another example of a tool holder in accordance with this invention.

FIG. 9 depicts an example of a tool holder in accordance with this invention comprising a rider plate 60 disposed in facing contact against the pad 10 and coupled to the pad 10 by the rivets 24. The rider plate 60 reduces frictional travel which may be desired in some situations, preventing wear of the pad 10 by swivel action of element 16. The portion of the swivel element 16 against the loop, primarily the tabs 38, ride against the plate 60.

In use, the pad 10 is looped on the wearer's waist belt and the tool loop 20 is pivotally lowered to the extending position. A tool such as a hammer or hatchet having a shaft is inserted in the tool loop 20, the shaft bearing on the tool loop 20 and swiveling the loop 20 for insertion. The wearer may walk and move as the hammer, for example, is allowed to swivel over an arc in excess of about 60°, which is adequate to prevent tools from falling out from the tool loop 20 upon ordinary bending movements of the wearer. This also prevents constant jarring motion against the wearer which would otherwise result if the tool loop 20 would not swivel. The hammer may then be removed from the loop 20 by grasping the hammer crosspiece or shaft, swiveling the hammer and the loop 20 about the swivel axis and pulling the hammer away from the loop.

While the invention has been particularly shown and described with reference to a preferred embodiment thereof, it will be understood by those skilled in the art that various changes in form and details may be made therein without departing from the spirit and scope of the invention.

What is claimed is:

1. A tool holder for supporting from a waist belt an implement of the type having a shaft and a crosspiece transverse to the shaft, comprising:

pad means for supporting a tool suspension arrangement adjacent thereto;

a protruding support element including means spaced apart from the pad means for supporting pivot means generally normal to the pad means;

pivot means coupled to the pad means defining a swivel axis normal to the pad and the support element for swivelably supporting a tool suspension loop; and means including a tool loop pivotally coupled to the pivot means and spaced apart from the swivel axis for suspending a tool of the aforementioned type in swivelable relationship from the tool crosspiece so that a shaft of a tool when inserted in the loop remains in a generally upright position and is prevented from falling out of the loop when the pad means is at an angle to a nominal wearing position and so that the tool and the tool loop may be readily rotated facilitating tool insertion and removal from the tool loop and enhancing the comfort of the wearer.

2. The invention as set forth in claim 1 and in which:

the pivot means comprises a pivot rod defining a swivel axis;

the means including a tool loop comprises swivel means pivotally coupling the pivot rod to the tool loop, the tool loop defining a pivot axis and being pivotable thereabout, the pivot axis spaced apart and normal to the swivel axis so that the tool loop is movable from a position extending laterally and generally normal to a plane tangential to the pad means when in use, to a second position upright and substantially flush against the pad means.

3. The invention as set forth in claim 2 and in which:

the pad means comprises a pliant piece having means for coupling the pad to a waist belt;

the swivel means comprises an apertured portion pivotally coupled to the pivot means and means partially surrounding the tool loop about the pivot axis holding the tool loop in force fitting frictional relationship; and the tool loop comprises means for limiting downward rotation of the tool loop when in use below the lateral position.

4. The invention as set forth in claim 3 and in which:

the protruding support element having facing spaced apart side regions extending from the pad, the pivot means disposed between the side regions, the swivel means defining a width adjacent the lower portion of the side regions and the side regions being sufficiently spaced apart to allow the tool loop to swivel about an arc in excess of about 60°.

5. The invention as set forth in claim 1 and in which:

the pivot means defining a pivot axis extending normal from the pad;

the means including a tool loop includes a swivel element defining a pivot arm for pivotally suspending the tool loop remote from the pivot means to rotate about the swivel axis.

6. The invention as set forth in claim 5 and in which:

the swivel means extending from the pivot means to define a plane of rotation generally parallel to the pad and normal to the pivot means, the tool loop being a rigid portion and joined to the swivel means remote from the pivot means to limit the frequency of tool sway, and the tool loop nominally defining a plane generally normal to the pad; and in which the swivel means being protectively covered about the swivel axis by the protruding support element.

7. A tool holder for supporting an implement of the type having a crosspiece and a longitudinal portion extending normal to the crosspiece, comprising:

a pliant pad;

a protective support element coupled to the pad, the support element including a portion spaced apart from the pad;

a pivot rod defining a swivel axis normal to a plane passing through the pad, the pivot element supported by the pad and the portion of the support element spaced apart from the pad;

means coupled to the rod to rotate about the swivel axis including a tool loop extending outward from and generally normal to the pad and spaced apart from the pivot rod to swivel about the pivot axis for facilitating tool insertion and removal and enhancing the comfort of a wearer, the means coupled to the rod comprising a swivel element, the tool loop being joined to the swivel element remote from the rod, the tool holder when in use maintaining an implement upright and minimizing tool sway.

8. The invention as set forth in claim 7 and in which:

the swivel element comprising a loop portion defining two spaced apart generally upright leaves and aperture means extending through each of the leaves, the rod extending through the aperture means so that the swivel element is rotatable about the rod, the swivel element further comprising a clip portion spaced apart from the loop portion for retaining the tool loop in pivotable relationship, the tool loop including a portion adjacent the pad defining a pivot axis and coupled to the clip portion of the swivel element to rotate from an outwardly extending position to a position substantially flush with the pad.

9. The invention as set forth in claim 8 and in which:

the tool loop comprises a nub extending generally normal to a plane passing through the loop when the loop is outwardly extended and engaging the swivel element when the loop is extended to the outward position to limit downward travel of the loop; and the support element comprising a pair of spaced apart end portions fastened to the pad and a forward portion spaced apart from the pad and side portions coupling the end portions to the forward portion, the side portions being sufficiently spaced apart and the swivel element having a sufficiently narrow shape with respect to the rod location so that the tool loop is allowed to swivel over an arc in excess of about 60°.

10. The invention as set forth in claim 9 and in which:

the tool loop is joined to the swivel element in frictional force fitting relationship so that the tool loop is maintained in the outwardly extending position or the flush position upon manual placement, the tool loop further having a flattened surface normal to a plane passing through the loop along a segment of the loop which is joined to the pivot element so that only limited manual effort is required to begin the movement of the tool loop from the position substantially flush with the pad toward the outwardly extending position;

the pad comprising leather and the end portions of the protective support element are riveted to the pad;

the protective support element comprising a top portion covering the rod and loop of the swivel element and extending to edges of the side portions and the forward portion; and the tool loop having an upward curved configuration remote from the pivot axis to direct the crosspiece of the tool towards the pad.

11. The invention as set forth in claim 7 and comprising rider plate means disposed against the pad for reducing frictional travel and protecting the pad as the pivot element swivels about the pivot axis, the portion of the swivel element adjacent the loop riding against the plate.

12. The invention as set forth in claim 7 and comprising means removably coupled to the tool loop for effectively reducing the size of the tool loop opening, including a plurality of clip-on portions and means extending central to the tool loop to provide separate openings and separate shoulders for suspending a plurality of tools.

13. The invention as set forth in claim 12 and in which the means coupled to the rod comprises a swivel element, the tool loop being pivotally coupled to the swivel element, remote from the rod in pivotal relationship to rotate from an outwardly extending position to a position substantially flush with the pad, and in which the tool loop is resiliently biased towards the pad, the loop extendable to an outward position upon the application of manual force about the tool loop axis.

14. The invention as set forth in claim 13 and comprising:

a spring element surrounding a portion of the tool loop adjacent the pad, the spring element terminating in a torque arm at each opposing end;

the tool loop comprising a nub extending generally normal to a plane passing through the loop limiting downward travel of the tool loop as the nub bears against the swivel element; and one of the torque arms of the spring bearing against and transverse to the nub of the tool loop and the other of the torque arms bearing on the swivel element biasing the tool loop toward the resilient pad; and comprising means for locking the tool loop in the outwardly extending position.

* * * * *

UNITED STATES PATENT OFFICE

CERTIFICATE OF CORRECTION

Patent No. 4,106,679 Dated August 15, 1978

Inventor(s) George Hillinger

It is certified that error appears in the above-identified patent and that said Letters Patent are hereby corrected as shown below:

The term of this patent subsequent to May 14, 1991 has been disclaimed.

Signed and Sealed this

*Tenth* Day of *October 1978*

[SEAL]

*Attest:*

RUTH C. MASON
*Attesting Officer*

DONALD W. BANNER
*Commissioner of Patents and Trademarks*